United States Patent [19]

Nayler et al.

[11] 4,244,628

[45] Jan. 13, 1981

[54] GUIDE ROLLER ASSEMBLY

[75] Inventors: Douglas W. J. Nayler; Michael R. Scalf, Sr., both of Houston, Tex.

[73] Assignee: NL Industries, Inc., New York, N.Y.

[21] Appl. No.: 130,227

[22] Filed: Mar. 14, 1980

Related U.S. Application Data

[63] Continuation-in-part of Ser. No. 923,321, Jul. 10, 1978, abandoned.

[51] Int. Cl.[3] ..... F16C 29/04

[52] U.S. Cl. ..... 308/6 R; 308/6 B

[58] Field of Search ..... 308/6 R, 3 R, 3 B, 3.8; 187/95, 96; 191/62

[56] References Cited

U.S. PATENT DOCUMENTS

| | | | |
|---|---|---|---|
| 3,829,175 | 8/1974 | Vogeli | 308/6 R |
| 3,835,269 | 9/1974 | Levin et al. | 191/62 |
| 3,878,614 | 4/1975 | Bruneau | 308/6 R |
| 4,047,597 | 9/1977 | Okura et al. | 308/3 B |

*Primary Examiner*—Lenard A. Footland

*Attorney, Agent, or Firm*—Arnold, White & Durkee

[57] ABSTRACT

A guide roller assembly is disclosed for use with vertically moving members such as in offshore drilling rigs. The assembly preferably includes a pair of guide rollers which are supported on a cylindrical, rotational mounting shaft, with a biasing means applying a torque to the shaft in order to maintain the guide rollers adjacent respective guide surfaces. An adjustment subassembly is provided to vary the position of the guide rollers with respect to the guide surfaces. This subassembly includes a tubular support which has an elongated circular opening receiving the cylindrical mounting shaft and which is mounted in a circular bore. The circular opening of the support is eccentric with respect to the circular bore, such that rotation of the support adjusts the position of the shaft and rollers.

18 Claims, 7 Drawing Figures

50
92
93
91
90
95
97
53
66
57
62
64
63
65
94
96
54
56
52
61
60
58
70
59
55
6
6
57
56
71
84
83
82
72
84
73
74
80
81
85
86

GUIDE ROLLER ASSEMBLY

CROSS-REFERENCE TO RELATED APPLICATION

This application is a continuation-in-part application of U.S. patent application Ser. No. 923,321 filed July 10, 1978, now abandoned, the disclosure of which is incorporated herein by reference.

BACKGROUND OF THE INVENTION

1. Field of the Invention

This invention generally relates to a guide assembly for a movable member, and to such a guide assembly including a channel-shaped guide track and one or more guide rollers. More particularly, the guide rollers are supported forvariable adjustment and are yieldingly biased toward respective guide track surfaces to accommodate misalignment in the guide track.

2. The Prior Art

In environments such as offshore drill rigs where certain members may be vertically moved and supported by rigid guide rail structures, damage is often encountered in guide roller assemblies or in the guide tracks as a result of misalignment in the track or as a result of shock loads. Such damage from misalignment is caused by the high loads placed on the components moving relative to each other and is particularly acute in offshore drill rigs, because the rig typically heaves and pitches from wave action.

In the past, the guide assemblies for vertically moving members, such as traveling blocks or motion compensators in a drill rig, have included either two fixed rollers or a single, larger roller positioned between guide surfaces of a channel shaped track. Invariably in this environment, the guide tracks become misaligned due to the constant forces from the elements, such misalignment causing failure in the rollers or roller bearings or damage to the rails. Repairing such damage involves not only the economics or replacement parts, but also requires down time for the vertically moving member during repairs.

As a result, the prior guide roller assemblies have included certain disadvantages, deficiencies, and drawbacks which have required their replacement due to premature failures.

SUMMARY OF THE INVENTION

The present invention overcomes these particular prior art shortcomings by a guide roller assembly which includes a guide track with spaced, generally parallel and generally vertical guide surfaces having a median axis between them. A pair of guide rollers are interconnected with a movable member, such as a motion compensator or traveling block in a drill rig, with the guide rollers being positioned between the parallel guide surfaces of the guide track. The outer diameter of the guide rollers is less than the horizontal distance between the guide surfaces so that each guide roller may freely rotate when in engagement with its respective guide surface. Means are provided for supporting the guide rollers such that the rotational axes of the rollers are spaced from one another in the direction of the guide track median axis and such that the guide rollers are positioned on opposite sides of the median axis to place each roller adjacent an associated, respective guide surface. In this arrangement, a line interconnecting the rotational axis of the guide rollers forms an acute angle with the median axis. Also provided is a means for biasing each roller toward its respective guide surface to either tend to maintain at least one of the rollers against a respective guide surface when a misalignment in the guide track is encountered, or to tend to maintain the rollers normally in a normal position where they are both marginally spaced from their respective guide surfaces, and to permit the rollers to accommodate misalignment in the guide track by allowing the rollers to displace in a direction generally perpendicular to the median axis.

In the preferred embodiment, the means for supporting the guide rollers includes a cylindrical shaft rotationally mounted through and supported by a support housing mounted on the movable member. The housing includes a generally tubular support having a circular support opening and a mounting bracket secured to the movable member and having an elongated circular bore receiving the tubular support. The support is releasably secured to the mounting bracket and the circular opening therein is eccentric with respect to the circular bore in the bracket such that the support may be released from the bracket and rotated within the bore of the bracket to adjust the position of the shaft and guide rollers relative to the guide member. Most preferably, the tubular support is comprised of a bearing material so that the shaft may be directly supported for rotational movement by the tubular support without separate bearing elements.

In the preferred embodiment, the means for biasing the rollers toward their respective guide surfaces, or towards a normal position where they are generally marginally spaced from their respective guide surfaces, includes a lever arm rigidly interconnected with the mounting shaft and a force applying or biasing member interconnected with the lever arm to produce a biasing torque through the shaft to the rollers.

The present invention provides numerous advantageous not found in the prior art arrangements. For example, this invention enables the guide rollers to accommodate errors in guide rail straightness and parallelism, thereby extending bearing life in the guide rollers, extending track life, and minimizing down time on certain components of drill rig assemblies.

As will be appreciated, if the guide rail in a drill rig becomes worn, the distance between the opposing guide rail surfaces increases. With prior art devices, the fixed guide rollers will not follow this worn area, leaving the moving member unstabilized to develop a slight horizontal displacement which may produce undesirable forces. The embodiments of the present invention where the rollers are designed to be biased into contact with their respective guide surfaces minimize the unsupported horizontal movement by biasing the rollers into contact with their respective guide track surfaces even when the distance between opposing surfaces increases.

In the embodiments of the invention where the rollers are designed to be biased into a normal position where they are marginally spaced from their respective guide rail surfaces, wear on the rollers and roller bearings will be reduced substantially.

As will also be appreciated, if a guide track is misaligned to reduce the distance between the guide track surfaces, the embodiments of the present invention will enable the rollers to displace toward the opposed guide surface to eliminate binding and undesirable damage to either the guide track, the guide rollers, or the guide roller bearings.

The present invention also cushions shock loads by transmitting horizontal forces from the rollers to the biasing member. That is, if the guide rollers are subjected to a load in the horizontal direction, i.e., in a direction perpendicular to the guide track, the guide rollers transmit that force to the biasing and force applying member which resists the load. In the preferred embodiment having a compression belleville spring, the applied force increases as the springs are compressed in order to counteract the shock load.

These and other advantageous and meritorious features will be more fully appreciated from the following detailed description and the appended claims.

DETAILED DESCRIPTION OF THE PREFERRED EMBODIMENTS

Figure 1:
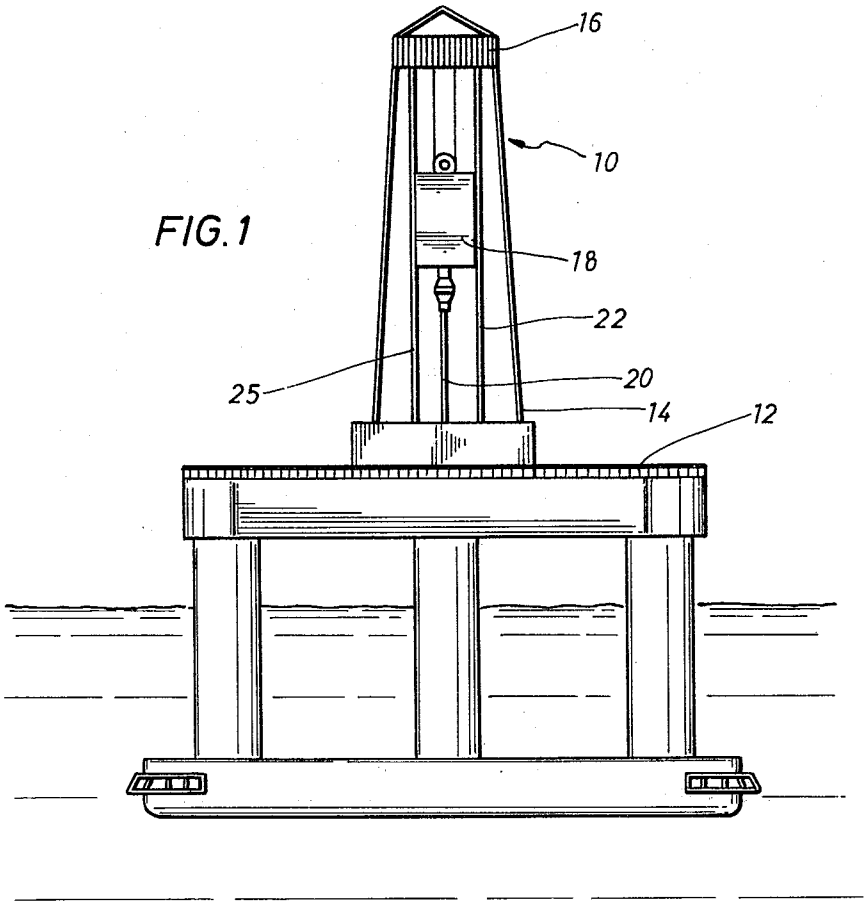
FIG. 1 schematically illustrates an offshore drilling rig, which is a suitable environment for implementing the present invention of a guide roller assembly.

The present invention relates to a guide roller assembly, which may be used in various environments such as in an offshore drilling rig as shown schematically in FIG. 1 by reference numeral 10. Such a rig might include, for example, a floating, semisubmersible drill rig having a drill floor on which is mounted a derrick 14. As is typical, the derrick will support in its top portion 16 a crown block (not shown), i.e. fixed top sheave assembly, over which are reeved cables that are reeved around a traveling block of a movable member 18. This movable member may include various components, such as a drill string compensator (not shown) having a main frame and hook frame as is typical in the art. A drill string shown by reference numeral 20 is supported by the drill string compensator and extends downwardly through the floating drill floor and downwardly into a drill hole. The movable member 18 is typically guided for vertical movement by a plurality of guide rails, shown by reference numerals 22 and 25, which extend downwardly from the top 16 of derrick 14 to or just above the floating deck 12.

As will be appreciated, the foating drill floor 12 heaves and pitches in response to seawater wave action. To maintain the drill string substantially in the same position relative to earth, motion compensators have been developed in the prior art and may form a component of movable member 18. However, moving member 18 and guide rails 22 and 25 are subjected to a pitching and heaving motion which enhances shockloads between the moving members and the fixed guide rails and increases the possibility of the guide rails becoming misaligned relative to the guide roller assembly associated with the moving members. It is these problems that the present invention are directed at.

Figure 2:
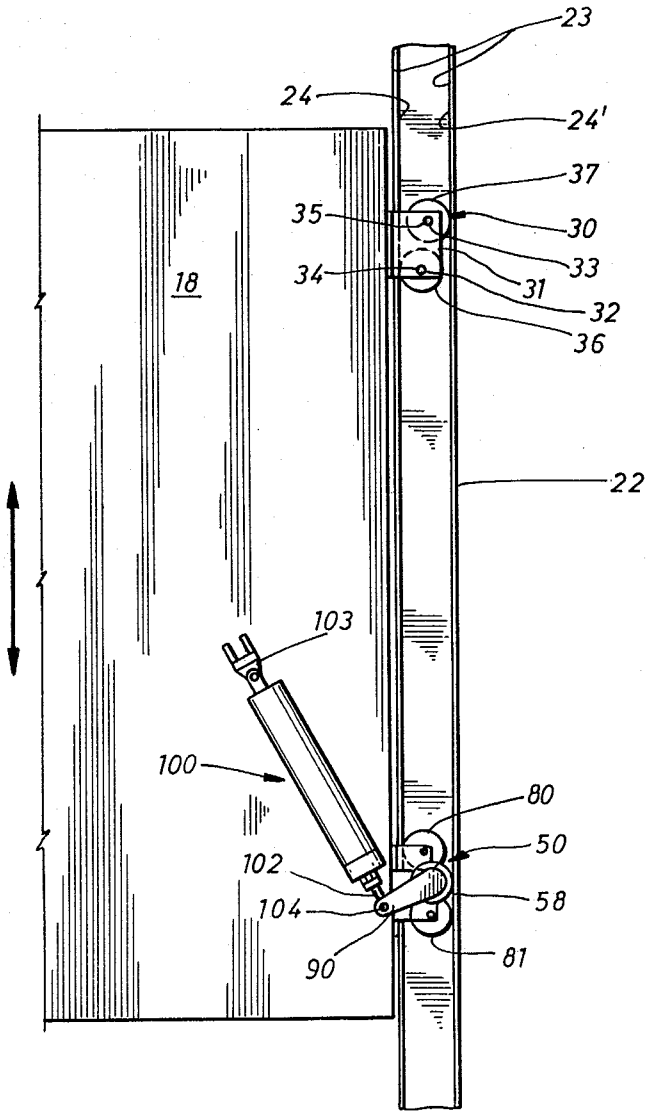
FIG. 2 generally illustrates one embodiment of the guide roller assembly of the present invention as mounted on a moving member, such as a travelling block or drill string compensator of a drill rig.

Referring to FIG. 2, half of the moving member 18 is illustrated schematically as positioned adjacent vertical guide rail 22. Such guide rails are typically channel-shape, including a pair of generally parallel flanges 23, defining a pair of generally parallel guide surfaces 24 and 24'.

As shown in FIG. 2, two separate and different guide roller assemblies 30 and 50 are mounted to top and bottom portions, respectively, of the moving member 18. Guide roller assembly 30 represents a prior art arrangement of dual guide rollers, with assembly 50 representing an embodiment of the present invention to overcome the shortcomings in the prior art. The guide roller assembly of the present invention may be used in combination with guide roller assemblies such as that shown by reference numeral 30, or several sets of guide roller assemblies 50 may be used in combination on a single moving member. For example, in the environment of a drilling rig, guide roller assemblies 50 may be employed on a motion compensator, with prior type guide roller assemblies being used on other moving components such as the travelling block, if experience shows that certain roller combinations are not experiencing wear from misalignment, shockloads, or the like.

Roller assembly 30 includes an angle mounting bracket 31 secured to the moving member 18. Circular openings 32 and 33 are formed in an outwardly extending flange of the mounting bracket 31 to receive roller shafts 34 and 35 which respectively carry and rotationally support guide rollers 36 and 37. As shown, the shafts 34 and 35 are offset with respect to a vertical median axis of the guide rail 22 such that roller 36 is adjacent or engaging guide surface 24, whereas guide roller 37 is adjacent or engaging guide surface 24'. Such an assembly accommodates some misalignment in the guide track 22, but excessive wear has been encountered in some instances.

Figure 3:
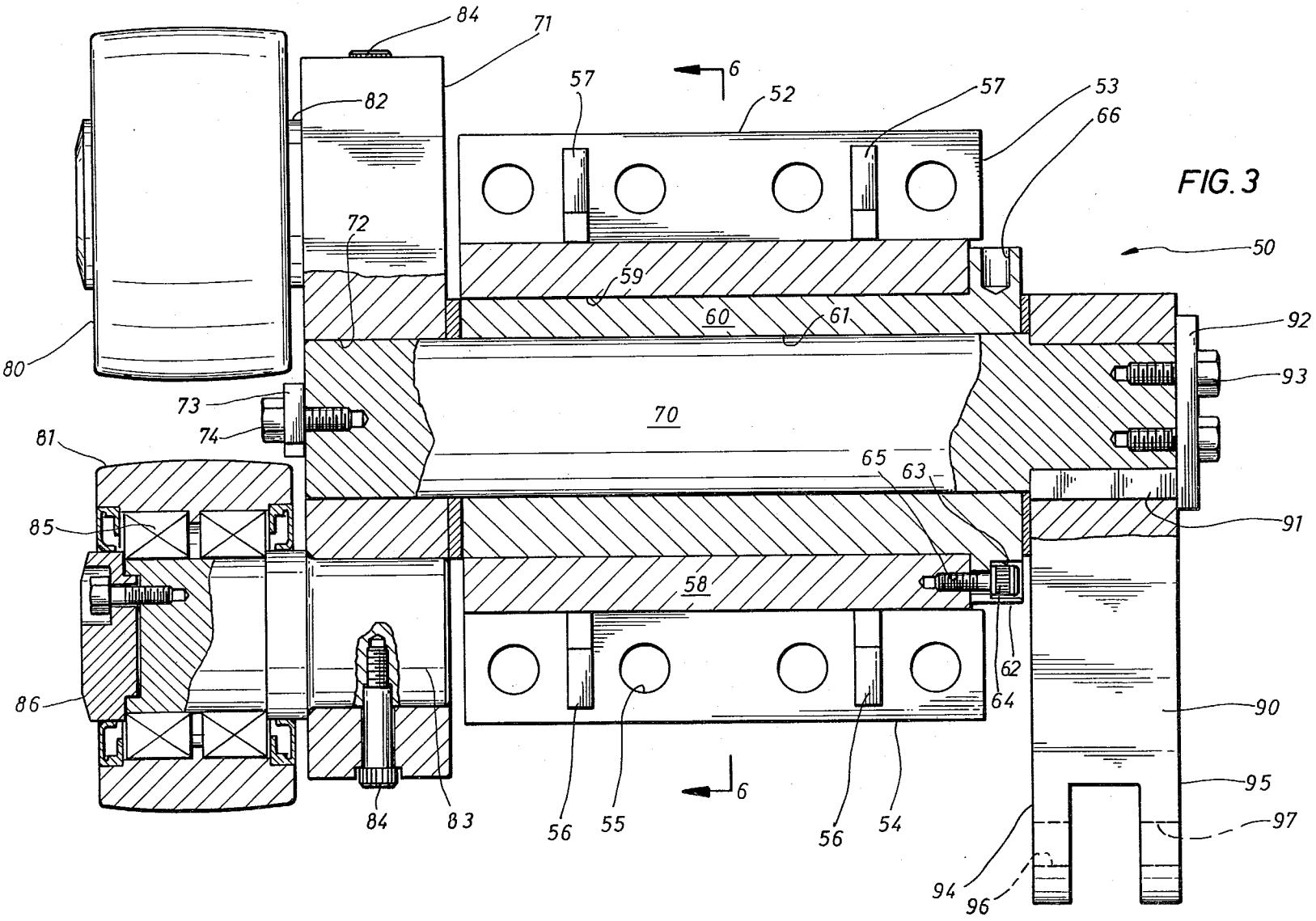
FIG. 3 is a partial sectional view illustrating the guide roller assembly of the present invention in detail.

Referring both to FIGS. 2 and 3, the guide roller assembly 50 of the present invention includes a mounting bracket 52 which is rigidly connected to the moving member 18. The bracket includes a pair of base members 53 and 54 having a plurality of openings 55 to receive bolts for securing the guide roller assembly to the moving member 18. Respective sets of gussets 56 and 57 are rigidly interconnected to base members 53 and 54 and are in turn rigidly interconnected with an elongated, generally tubular housing member 58.

Figure 4:
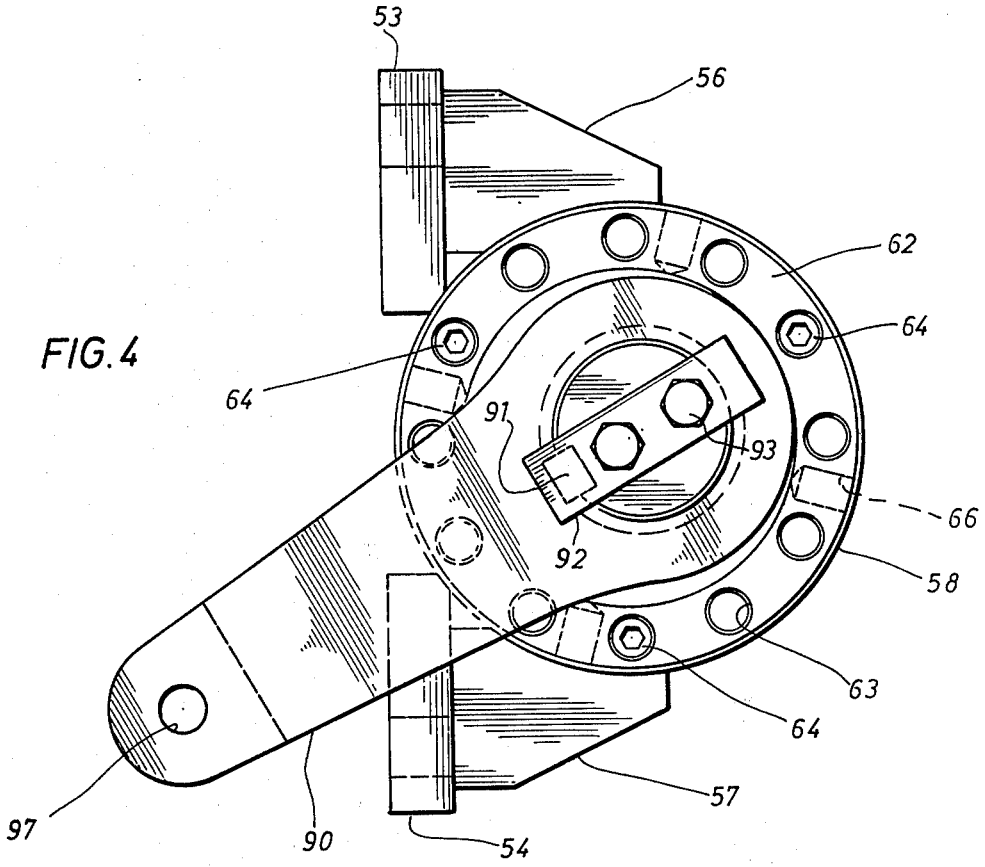
FIG. 4 is one end view of the guide roller assembly, illustrating a lever arm which is connected to biasing means to apply a biasing torque to the guide rollers of the guide assembly.
Figure 6:
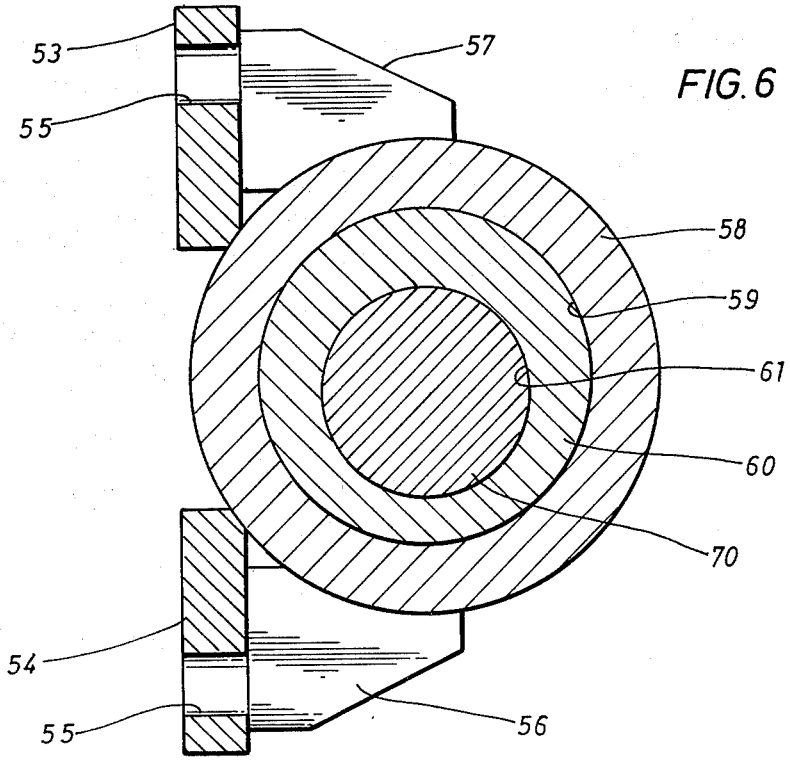
FIG. 6 is a cross sectional view taken along plane 6—6 as indicated in FIG. 3 and illustrating the eccentricity of the guide roller mounting shaft with respect to the housing to provide a means for adjusting the position of the guide rollers with respect to the guide track.

As illustrated in FIG. 6, tubular housing member 58 includes an elongated circular bore 59 into which is inserted an elongated, generally tubular support sleeve 60. This sleeve likewise includes an elongated circular bore 61 which is eccentric with respect to the bore 59 for purposes which will be more fully explained below. FIG. 3 illustrates that the support sleeve 60 preferably includes an enlarged, radially extending flange 62 at one end which abuts against the respective end of housing 58. FIG. 4 shows that this flange 62 includes a plurality of circumferentially spaced openigns 63 which accommodate variable rotational positioning of the support sleeve 60 relative to the housing 58. In the preferred embodiment, twelve such openings are employed at positions 30° from one another around the flange 62. Three or more bolts 64 may be inserted through three of the openings 63 which are in alignment with respective threaded openings 65 in housing member 58. By such an arrangement, the support sleeve may be releaseably secured to the housing 58 in a variety of positions to alter the position of opening 61. As shown in FIGS. 3 and 4, a plurality of radial openings 66 are provided around the periphery of flange 62 to accommodate the insertion of a tool for rotating support sleeve 60 relative to housing 58 after the bolts 64 have been withdrawn from threaded openings 65 in order to alter the position of bore 61.

Preferably, sleeve 60 is formed of a suitable bearing material to eliminate the necessity of using separate bearing elements, since sleeve 60 rotationally supports a mounting shaft 70. Suitable bearing materials are known in the art, and include materials such as aluminum bronze.

Figure 5:
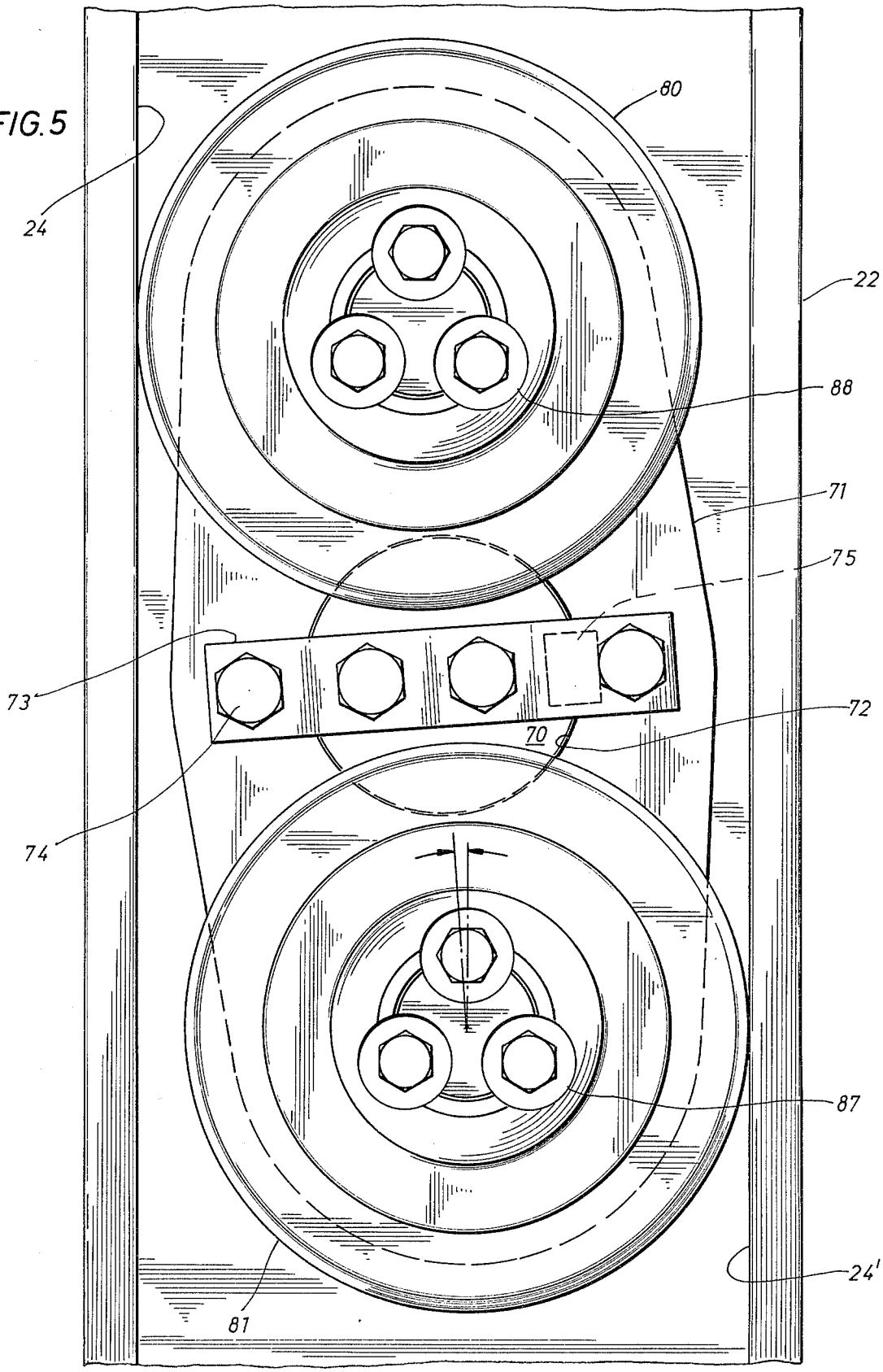
FIG. 5 is a second end view, illustrating the guide rollers.

As previously disclosed, an elongated cylindrical shaft 70 is rotationally supported within support sleeve 60, the shaft in turn supporting a pair of guide rollers 80 and 81. As best shown in FIGS. 3 and 5 collectively, rigidly connected to the shaft 70 is a metal bar 71 to which the guide rollers 80 and 81 are secured. The bar 71 includes a central circular opening 72 receiving one end of the shaft 70, with a metal plate 73 overlaying one face of the bar 71 and the end of the shaft 70. Plate 73 includes four openings as shown, through which bolts 74 extend for threaded receipt within respective threaded openings in the mounting shaft 70 and in the bar 71, two such threaded openings being provided in the shaft and two in the bar. Additionally, a key 75 is inserted within cooperating slots in the shaft and the bar, such that the key, the plate 73 and the bolts 74 maintain bar 71 and shaft 70 rigid.

Rollers 80 and 81 are each rotationally mounted on respective, fixed shafts 82 and 83 which are secured in position in bar 71 in any suitable manner, such as by a plurality of shoulder screws 84 positioned within respective threaded openings in bar 71.

Rollers 80 and 81 are each mounted on bearings 85 in a conventional manner and are maintained on their respective shafts 82 and 83 by end caps 86 which are secured in position on the shafts by a plurality of bolts 87 and 88.

As shown in FIG. 5, the outer diameter of guide rollers 80 and 81 is less than the horizontal distance between guide surfaces 24 and 24' of the guide track such that each roller is positioned adjacent to or against a respective guide surface. With such an arrangement, a line interconnecting the rotational axes of guide rollers 80 and 81 forms an acute angle with the imaginary median axis between guide surfaces 24 and 24'. In the illustrated embodiment, this acute angle is approximately four or five degrees, but this may be varied as desired.

In the embodiment illustrated in FIG. 2, as the moving member 18 is vertically displaced guide roller 80 preferably engages guide surface 24, with guide roller 81 likewise engaging surface 24'. However, misalignments may be encountered in the guide track such that only one of the rollers will be contacting its respective guide surface. To minimize the effects of such misalignments, the mounting shaft 70 is biased in a counter-clockwise direction, as viewed in FIG. 5, to maintain at least one of the rollers in engagement with a respective guide track, yet to allow bar 71 to be displaced either in a clockwise or counter-clockwise direction to accommodate misalignments and thereby diminish damage either to the guide track, the rollers, or the roller bearings.

The means for applying a biasing torque to the shaft 70 is best illustrated in FIGS. 2, 3, and 4 collectively. This biasing means includes a lever arm 90 rigidly secured to an end portion of the shaft 70 by securing members including: a key 91 received within complementary slots in the lever arm 90 and in the shaft 70; a metal plate 92 overlaying the end of shaft 70 and one side of lever arm 90; and a pair of bolts 93 received within openings of plate 92 and in threaded openings in the shaft 70.

The end of lever arm 90 includes a pair of parallel flange arms 94 and 95 having respective aligned openings 96 and 97. These flange arms receive a mounting arm (not shown) of a force applying member 100, such as a compression spring, tension spring, pneumatic cylinder, or hydraulic cylinder. In the preferred embodiment, the force applying member includes a belleville spring which applies a preset force of approximately 5,000 pounds to a movable rod 102 which is secured to the lever arm 90 by the mounting member. Force applying member 100 is pivotally secured to a mounting bracket 103 in a conventional manner, and a bolt or pin 104 extends through openings 96 and 97 of the lever arm 90 to secure the mounting member to the lever arm.

As will be appreciated, the force applied to movable shaft 102 transmits a moment force to the rotational mounting shaft 70 by way of the lever arm 90. This moment force is applied in a counter-clockwise direction as viewed in FIG. 2, such that a counter-clockwise force is transmitted along shaft 70, to bar 71, and to guide rollers 80 and 81 to maintain these rollers adjacent to or against respective guide surfaces 24 and 24'. As has been disclosed in previous portions of this application, such a biasing torque permits the rollers to accommodate misalignments in the guide track 22. Additionally, the biasing force applied to the roller will cushion shock loads experienced by the rollers as a result of the movable member 18 being subjected to the pitching and heaving motion of the drill deck 12. That is if the movable member 18 moves horizontally relative to the guide tracks 22 and 25, the rollers 80 and 81 along with the bar 71 will be displaced in either a clockwise or counter-clockwise direction against one of the guide roll surfaces. This rotational movement will be transmitted along mounting shaft 70 to lever arm 90 and through displaceable shaft 102 to the force applying member 100, which absorbs the shock load. In the preferred embodiment of a belleville type compression spring, displacement of shaft 102 as a result of such a shock load will compress the belleville spring and a resultant compressive force of up to approximately 10,000 pounds will be developed in the force applying member 100 to counter-balance the shock load.

To mount and accurately position the guide roller assembly of the present invention, the base members 53 and 54 of the mounting bracket are positioned in alignment with respective threaded openings in the movable member 18 to receive bolts. Shims may be placed between the movable member 18 and the base members to roughly adjust the guide rollers 80 and 81 with respect to the guide surfaces 24 and 24', it being desirable that each guide roller contact its respective guide surface when the assembly is mounted. To then more accurately adjust the position of the guide rolers to the desired position, it may be necessary to rotate support sleeve 60 relative to housing member 58 to adjust the position of shaft 70. This is accomplished by retracting bolts 64 from their respective threaded openings 65 in sleeve 58 and then inserting a tool into one of the radial openings 65 to rotate the sleeve. When both rollers 80 and 81 engage their respective guide surfaces, the bolts may then be inserted back into one of the openings 63 which should be placed in alignment with the nearest threaded opening 65 in the housing. Then, the guide roller assembly is ready for use to absorb shock loads and to accommodate misalignments in the guide tracks, as disclosed herein.

Figure 7:
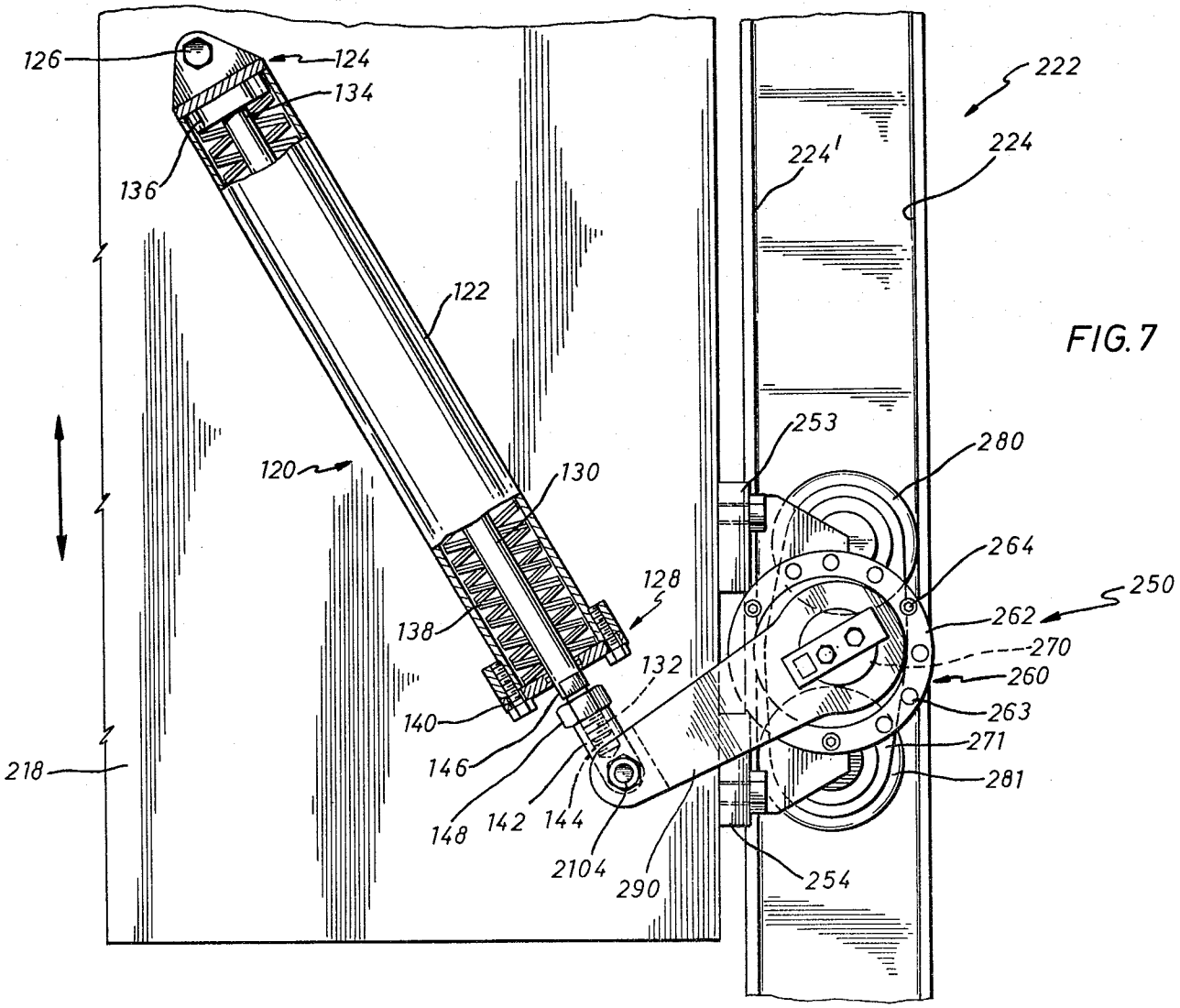
FIG. 7 is a fragmentary view generally illustrating an alternative embodiment of the guide roller assembly of the present invention as mounted on a moving member for guiding movement of the moving member along a guide track.

With reference to FIG. 7 of the drawings, reference numeral 250 refers generally to an alternative embodiment of a guide roller assembly in accordance with this invention.

The guide roller assembly 250 corresponds in a number of respects with the guide roller assembly 50 as illustrated in the prior figures of the drawings. Parts of the guide roller assembly 250 which correspond with parts of the guide roller assembly 50 have therefore been indicated by corresponding reference numerals except that the prefix "2" has been added to the reference numerals employed in the previous figures of the drawings.

The guide roller assembly 250 is identical to the guide roller assembly 50 except for the biasing member 120 shown in the embodiment of FIG. 7. That biasing member is similar in operation and function to the force applying member 100, in that both apply a biasing force to the support shafts 70, 270, both accommodate displacement of the guide rollers when a misalignment is encountered, both maintain at least one of the rollers against a guide track flange when a misalignment is encountered, and both are capable of cushioning shock loads. In the embodiment shown in FIG. 7, the biasing means serves to normally maintain the guide rollers in a slightly spaced position from the guide surfaces in order to reduce wear of the rollers.

The biasing means 120 comprises a biasing cylinder 122 having a free end 128 and a fixed end 124 which is pivotally mounted on the movable member 218 by means of a bolt 126.

The biasing means 120 further comprises a displaceable rod biasing arm 130, part of which is located within the biasing cylinder 122. An outer end portion 132 of biasing arm 130 projects from the free end 128 of the cylinder 122, and as inner end portion 134 is positioned within the cylinder 122. A cylindrical abutment plate 136 mounted at the inner end 134 of arm 130, such that the biasing arm 130 is axially displaceable within the biasing cylinder 122.

The biasing means 120 further comprises a belleville type compression spring 138 located within the biasing cylinder 122 between the abutment plate 136 and an abutment end wall 140 which is secured to the free end 128 of the cylinder 122 by bolts, as shown, or by any other suitable attachment means. The belleville type compression spring 138 thus serves to bias the abutment plate 136 and the biasing arm 130 toward the fixed end 124 of the cylinder 122.

The biasing means further comprises an adjustment sleeve 142 which is pivotally connected to the lever arm 290 by means of a bolt or pin 2,104. The adjustment sleeve 142 has a threaded bore 144, while the outer end portion 132 of the biasing arm 130 is threaded externally and cooperates with the threaded bore 144. A lock nut 148 also includes internal threads which cooperate with the external threads on the biasing arm 130 to lock the biasing arm into the desired position, to place the rollers 280 and 281 in their proper position in the guide track assembly 222.

The biasing arm 130 has a square or hex portion 146 for receiving a spanner or wrench to allow the biasing arm 130 to be rotationally displaced about its elongated axis when required, as will be explained later.

The guide roller assembly 250 is mounted in a corresponding manner to which the guide roller assembly 50 is mounted as hereinbefore described.

Thus the base members 253 and 254 of the mounting bracket are positioned in alignment with respective threaded openings in the movable member 218 to receive bolts. Shims may be placed between the movable member 218 and the base members to roughly adjust the guide rollers 280 and 281 with respect to the guide surfaces 224 and 224'.

Thereafter, to more accurately adjust the position of the guide rollers to a desired position, it may be necessary to rotate support sleeve 260 relative to its housing member which corresponds with the housing member 58 of the guide roller assembly 50 to pivotally adjust the position of its shaft 270 which corresponds to the shaft 70 of the guide roller assembly 50. This will be accomplished in exactly the same manner as hereinbefore described.

Thereafter, by applying a suitable spanner or wrench to the square section portion 146, with the lock nut 148 in a released position, the effective length of the biasing arm 130 can be adjusted by rotating the biasing arm. During such rotational displacement there will be relative axial displacement between the adjustment sleeve 142 and the threaded outer end portion 132 of the biasing arm 130. Such adjustment can be continued until the rollers 280 and 281 are spaced the desired normal distances from their respective adjacent guide surfaces 224 and 224'.

The appropriate spacing will depend upon the condition of the guide surfaces, the bulk of the movable member, the type of conditions which will be experienced in practice and the like. Preferably, however, the spacing will be adjusted so that the rollers 280 and 281 are spaced by a distance of about $\frac{1}{8}$th to $\frac{1}{4}$ inch from their adjacent guide surfaces.

Once the adjustment has been effected, the lock nut 148 can be tightened onto the adjustment sleeve 142 to lock the biasing arm against any further rotational displacement.

In use, therefore, the biasing means 120 will bias the rollers 280 and 281 towards a normal position and will tend to maintain them in their normal position, where each roller is marginally spaced from its respective guide surface thereby combatting excessive wear of the rollers themselves, of their bearings, and of the guide surfaces during use.

If a misalignment has occurred in the guide rail 222 so that the guide surfaces have been displaced closer to each other, such misalignment can be accommodated since the rollers can be pivotally displaced in a counterclockwise direction as viewed in FIG. 7 to accommodate such misalignment. Such pivotal displacement is permitted by displacement of the lever arm 290, resulting in displacement of the biasing arm 130 and the abutment plate 136 along the axis of cylinder 122 against the biasing action of the belleville compression spring 138.

Once the misalignment has been traversed, the biasing means 120 will again tend to bias the rollers 280 and 281 to their normal position where they can be marginally spaced from their respective guide surfaces.

The embodiment of the invention as illustrated in FIG. 7 of the drawings can therefore provide the advantage that the rollers 280 and 281 are not maintained in preload all the time thereby reducing wear on the rollers and on their bearings. Additionally, the spacing between the rollers and their respective guide surfaces can be adjusted readily and effectively when desired.

It will be appreciated that various modifications may be made to the preferred embodiments without departing from the spirit of this invention. For example, various alternative arrangements may be employed for applying the desired biasing force to the guide rollers 80 and 81 to accommodate displacement of the rollers in response to misalignment in the guide track 22. Likewise, various types of force applying members may be used to exert the biasing torque to the guide rollers. Alternatively, the support structure with the eccentric adjustment feature might be used in an environment including a single guide roller on a cylindrical mounting shaft. Further, the rollers may be biased without necessarily employing the eccentric adjustment feature.

We claim:

1. A guide roller assembly including a pair of guide rollers carried by a movable member, the guide rollers being suited for placement within an elongated guide track having an axis of displacement and a pair of generally parallel guide track flanges on each side of said displacement axis, and the guide rollers being spaced such that a line interconnecting the roller's respective axes of rotation forms an acute angle with said displacement axis, the improvement of:

a rigid member rotationally supporting said guide rollers, the rigid member being rigidly interconnected with a mounting shaft which is rotationally mounted in a support carried by the movable member, the rigid member supporting said pair of guide rollers for placement within said guide track such that each of said rollers is positioned against or adjacent a respective guide flange; and biasing means functionally interconnected with said mounting shaft for applying a biasing torque to said mounting shaft and thereby to the rigid member (a) to maintain at least one of said rollers against a respective flange when a misalignment in the guide track is encountered, (b) to permit the rollers to accommodate misalignment in the guide track by allowing the rigid member to experience biased rotational movement such that the rollers are displaced together along a circumferential path, and (c) to cushion a shock load when the movable member is subjected to a force having a directional component perpendicular to that of the displacement axis by absorbing the shock load with one of said guide rollers and transmitting that load through the rigid member to said biasing means.

2. The guide roller assembly as defined in claim 1, further including a lever arm rigidly interconnected with said mounting shaft, and said biasing means comprising a force applying member interconnected with said lever arm.

3. The guide roller assembly as defined in claim 2, characterized by the force applying member continuously applying a biasing force to the rigid member when the rollers are positioned in the guide track.

4. The guide roller assembly as defined in claim 1, characterized by said support being formed of a bearing material such that the mounting shaft may be directly supported for rotational movement by the support without separate bearing elements.

5. The guide roller assembly as defined in claim 1, characterized by said support including a generally tubular member having an elongated circular bore therethrough receiving the mounting shaft, and wherein the support is releaseably secured within a housing having a circular bore therethrough, the circular bore of the support being eccentric with respect to the housing, such that said support may be unsecured and rotated within said housing to adjust the position of the mounting shaft and the guide rollers.

6. For use in a drilling rig which includes a vertically movable member, such as a motion compensator or traveling block, and at least one vertical guide member having a pair of spaced, generally parallel, vertical guide surfaces; a guide roller assembly comprising:

a housing suited for mounting on the movable member of said drill rig and including a circular support opening;

a cylindrical shaft rotationally mounted through and supported by said support opening;

a pair of rotatable guide rollers interconnected with said shaft and suited for placement in said vertical guide member between the vertical guide surfaces, with the outer diameter of each of said rollers being less than the horizontal dimension between the guide surfaces; and means for applying a rotational biasing force to the shaft in order to bias the guide rollers toward respective guide surfaces, yet to permit the guide rollers to displace in response to misalignment in the guide member.

7. The guide roller assembly as defined in claim 6, characterized by said housing including a generally tubular support defining said circular support opening, and a mounting bracket secured to the movable member and including an elongated circular bore receiving said tubular support, the support being releaseably secured to the bracket and the circular support opening being eccentric with respect to the circular bore in the bracket such that the support may be released from the bracket and rotated within the bore of the bracket to adjust the position of the shaft and guide rollers relative to the guide member.

8. The guide roller assembly as defined in claim 7, characterized by said tubular support being formed by a bearing material.

9. A guide assembly for a vertically movable member, comprising:

a guide track with spaced, generally parallel, and generally vertical guide surfaces having a median axis of displacement therebetween;

a pair of guide rollers interconnected with said movable member and positioned between the parallel guide surfaces of the guide track, the outer diameter of said guide rollers being less than the distance between said guide surfaces;

first means for rigidly supporting the guide rollers in spaced apart relationship such that the rotational axes of the rollers are spaced from one another along the direction of the median axis and are positioned on opposite sides of said median axis such that each roller is associated with a respective guide surface and such that a line interconnecting the rotational axes forms an acute angle with the median axis; and second means functionally interconnected with said first means for biasing each roller toward its respective guide surface (a) to maintain at least one of said rollers against a respective guide surface when a misalignment in the guide track is encountered and (b) to permit the rollers to accommodate misalignment in the guide track by allowing the rollers to displace in a direction generally perpendicular to the median axis.

10. A guide roller assembly, comprising:

a rotational mounting shaft supporting at least one rotatable guide roller; a generally tubular support member including an interior, elongated circular opening through which the shaft is mounted for support; a mounting bracket including an elongated circular bore through which the support member is mounted; the support being releaseably secured to the mounting bracket; and the circular opening of the support and the circular bore of the bracket being eccentric such that the support may be released and rotated within the bracket to adjust the position of the mounting shaft.

11. For use in a drilling rig which includes a vertically movable member, such as a motion compensator or traveling block, and at least one vertical guide member having a pair of spaced, generally parallel, vertical guide surfaces; a guide roller assembly comprising:

a housing suited for mounting on the movable member of said drill rig and including a circular support opening;

a cylindrical shaft rotationally mounted through and supported by said support opening;

a pair of rotatable guide rollers interconnected with said shaft and suited for placement in said vertical guide member between the vertical guide surfaces, with the outer diameter of each of said rollers being less than the horizontal dimension between the guide surfaces; and means for applying a biasing force to the shaft.

12. A guide assembly for a movable member, comprising:

a guide track with spaced, generally parallel opposed guide surfaces having a median elongated axis of displacement therebetween;

a pair of guide rollers interconnected by means of a housing member with said movable member and positioned between the generally parallel guide surfaces of the guide track, the outer diameter of each guide roller being less than the distance between said guide surfaces;

support means for rigidly supporting the guide rollers in spaced apart relationship on the housing member such that the rotational axes of the rollers are spaced from one another along the direction of the median axis and are positioned on opposite sides of said median axis such that a line interconnecting the rotational axes forms an acute angle with the median axis; and biasing means functionally interconnected with said support means for biasing one roller towards one guide surface and the other roller towards the other guide surface, the biasing means being adjustable generally to maintain the rollers in a normal position where each roller can be marginally spaced from its respective guide surface, and the biasing means being such as to permit the rollers to accommodate misalignment in the guide track by allowing the rollers to displace relatively to the guide surfaces in a direction transversely to the median axis.

13. A guide assembly according to claim 12, in which the biasing means comprises a displaceable biasing arm functionally connected to the support means, and a bias force applying member associated with the biasing arm to bias the arm to a rest position.

14. A guide assembly according to claim 13, in which the biasing means is adjustable by virtue of the effective length of the biasing arm being adjustable.

15. A guide assembly according to any one of claims 12 to 14, in which the support means is pivotably displaceable relatively to the housing member about an axis extending generally parallel to the guide surfaces and transversely to the median axis, and in which the biasing means is adjustable by pivotally adjusting the position of the support means relatively to the housing member.

16. For use in a drilling rig which includes a vertically movable member, such as a motion compensator or travelling block, and at least one vertical guide member having a pair of opposed spaced, generally parallel, vertical guide surfaces, a guide roller assembly comprising:

a housing suited for mounting on the movable member of said drill rig and including a circular support opening;

a cylindrical shaft rotationally mounted through and supported by said support opening;

a pair of rotatable guide rollers interconnected with said shaft and suited for placement in said vertical guide member between the vertical guide surfaces, with the outer diameter of each of said rollers being less than the distance between the guide surfaces; and biasing means for applying a biasing force to the shaft during use to bias one roller towards one guide surface and the other roller towards the other guide surface, the biasing means being adjustable generally to maintain the rollers in a normal position where each roller is marginally spaced from its respective guide surface during use, and the biasing means being capable of accommodating pivotal displacement of the shaft when a track misalignment is encountered.

17. A guide roller assembly comprising:

(a) a pair of spaced guide rollers carried by a movable member, the guide rollers being suited for placement within an elongated guide track having an elongated axis of displacement and a pair of generally parallel, opposed guide track flanges on each side of the displacement axis;

(b) a housing member mounted on the movable member, the housing member having a cylindrical bore;

(c) a mounting member pivotably mounted within the cylindrical bore, the mounting member supporting the guide rollers for placement within such a guide track such that each of such rollers can be adjacent a respective guide flange;

(d) biasing means functionally interconnected with said mounting member for applying a biasing torque to said mounting member to bias one roller towards one flange and the other roller towards the other flange during use, the biasing means being adjustable to allow the biasing means during use to maintain the rollers generally in a normal position where each roller can be marginally spaced from its respective flange.

18. A method of guiding a movable member along a guide track and accommodating misalignment in the guide track, the method comprising the steps of:

(a) positioning a pair of guide rollers which are mounted on the movable member, in a guide track such that each roller is associated with one surface of a pair of generally parallel, laterally spaced guide surfaces of the track, the guide rollers being interconnected with each other by a pivotable support member;

(b) biasing the guide rollers towards a normal rest position where each roller can be marginally spaced from its respective guide surface during displacement of the movable member along portions of the guide track that are properly aligned, (c) accommodating pivotal displacement of the support member by the rollers when the rollers encounter a misalignment in the guide track; and (d) biasing the rollers back to their normal rest position after the rollers have passed the misalignment.

* * * * *